US006957838B2

(12) United States Patent
Nowak

(10) Patent No.: US 6,957,838 B2
(45) Date of Patent: Oct. 25, 2005

(54) TRUSS LIFT STIFFENER

(76) Inventor: Clarence Nowak, Rte. 650, Horton, MO (US) 64788

( * ) Notice: Subject to any disclaimer, the term of this patent is extended or adjusted under 35 U.S.C. 154(b) by 0 days.

(21) Appl. No.: 10/851,874

(22) Filed: May 21, 2004

(65) Prior Publication Data

US 2004/0256870 A1 Dec. 23, 2004

Related U.S. Application Data

(60) Provisional application No. 60/473,860, filed on May 28, 2003.

(51) Int. Cl.[7] ..... B66C 1/16

(52) U.S. Cl. ..... 294/67.1; 294/81.56; 52/122.1

(58) Field of Search ..... 294/81.1, 81.5, 294/81.56, 81.6, 67.1, 67.4, 67.41, 67.3; 52/122.1, 125.1, 125.2; 414/10–12

(56) References Cited

U.S. PATENT DOCUMENTS 2,646,305 A * 7/1953 Sonderstrup ..... 294/81.5
3,450,280 A * 6/1969 Colnot ..... 294/67.21
4,026,592 A * 5/1977 Powers ..... 294/65.5
4,355,832 A * 10/1982 Andersen ..... 294/81.3
4,397,492 A * 8/1983 Craig ..... 294/81.56
5,934,038 A * 8/1999 Clausen ..... 52/745.2
2004/0094982 A1 * 5/2004 Neufeldt ..... 294/82.24

* cited by examiner

*Primary Examiner*—Dean J. Kramer
(74) *Attorney, Agent, or Firm*—Mark Manley

(57) ABSTRACT

A stiffener device for use in moving a truss is disclosed. A crane lift cable is attached to a spreader bar. Two lines from the spreader bar attach to the truss to move the truss using a crane. A stiffener body attachable to the truss by brackets allows the stiffener body to hang on the bottom chord of the truss. The stiffener body provides a significantly increased resistance to bending along the length of the truss. This stiffening prevents bending and flexing of the truss which can reduce the numbers of damaged trusses that can occur when setting trusses to a building structure.

11 Claims, 9 Drawing Sheets

TRUSS LIFT STIFFENER

RELATED APPLICATIONS

This application claims priority of provisional patent application 60/473,860 filed May 28, 2003.

BACKGROUND OF THE INVENTION

In the construction industry it is common to need to set large prefabricated trusses. At the present time it is common to use a crane and a spreader bar when setting a long item such as a prefabricated truss. The spreader bar commonly allows for 2 points of attachment to the truss which gives the crane operator better control of the truss as it is being moved into a position where it can be set on a structure.

Setting a truss currently requires the crane operator and at least two workmen to aid in setting the truss. In the prior art it is known to attach ropes to the truss that workmen on the ground or on a structure use to help guide a truss into its proper location. The current approach is somewhat dangerous and very time intensive because the spreader bar fails to give the crane operator enough control over a truss which can bend and flex. Trusses can be of wood or metal and are designed to be strong once in place on a building. Many pre-fabricated trusses are not strong prior to mounting and are free to flex in a direction perpendicular to the plane of the truss. Failure to control a truss often leads to damaging or destroying the truss which can be fairly delicate prior to installation. Besides the loss of the value of the truss, a damaged truss can lead to very expensive delays as a crew scrambles to replace a truss that can be specially made for the specific application.

SUMMARY OF THE INVENTION

The present invention solves the limitations of the prior art approach. A truss moving device for use in combination with a crane lift cable attached to a spreader bar. A stiffener body attaches to a truss to prevent it from bending or flexing while it is being moved and positioned for installation on a structure.

In a further aspect the present invention provides a device for use with a lift cable in moving a load, the device comprising a lift cable attached to a spreader bar; a stiffener body attachable to the load to stiffen the load wherein the stiffener body is attached to the spreader bar.

In a still further aspect, a device for use with a lift for moving a truss, the device comprising a stiffener body adapted to removably attach to a bottom chord of the truss to stiffen the truss at least during moving;

wherein the stiffener body has a first position wherein the stiffener body is attached to the truss and a second position wherein the stiffener body is hanging from the lift.

In yet another aspect a device for use with a lift cable for moving a truss, the device comprising, a spreader bar; a stiffener body adapted to removably attach to a bottom chord of the truss to stiffen the truss at least during moving;

wherein the stiffener body has a first position wherein the stiffener body is attached to the truss and a second position wherein it is hanging from at least one of the spreader bar or the lift cable.

DETAILED DESCRIPTION OF THE DEVICE

Figure 1:
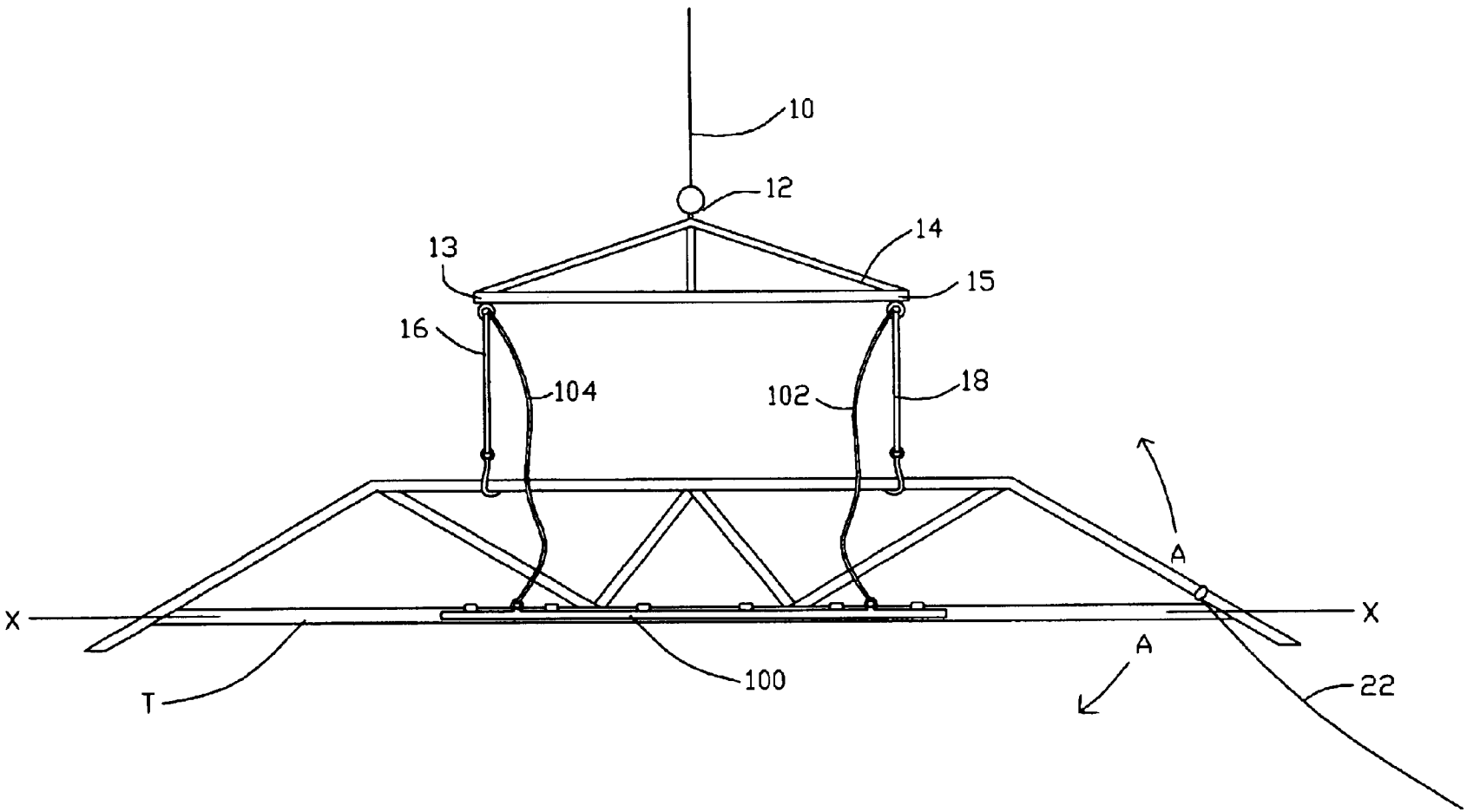
FIG. 1 Shows a view of the device in use with a truss.

FIG. 1 shows a view of the device 100 in use. A long load such as a truss T is lifted by a lift cable 10 attached to a crane not shown. A weight 12 provides for stability of the lift cable 10 particularly in a no load situation. A spreader bar 14 spreads the contact with the load out to increase stability of the truss T as it is moving. Two lines 16, 18 can attach the truss T to the spreader bar 14. A line 22 can be attached to the truss T or spreader bar 14 so that a person on the ground or on a structure can provide additional guidance to the truss T as it is moving from a pile of prefabricated trusses onto a structure for example.

Arrows A show a direction in which the truss T can bend. While a truss T can be designed to resist bending normally applied by a vertical load, the same truss can be quite weak in bending in other directions. This weakness to bending in non-design directions can lead to breakage of the truss T prior to installation. Flexing and breakage is particularly a problem with long trusses such as those in excess of 40 feet in length. Normally a truss T is designed so that it is relatively flat, usually no thicker than 4 times the width W of material used to build the truss T. Often times a wood truss is about the same thickness as the material, see FIG. 3 for example which shows a cross section of a board used in building a truss and that would also be the width W of the truss T. Such a thin material used in a long structure is weak to bending perpendicular to the length and perpendicular to the imaginary plane PP in which the center of the thin truss T lies. FIG. 1 shows a long axis X—X of the bottom chord of the truss T which is the same as a long axis of the stiffener body 106 (see FIG. 2). Bending of the long axis X—X is prevented by the relatively rigid stiffener body 106.

Figure 2:
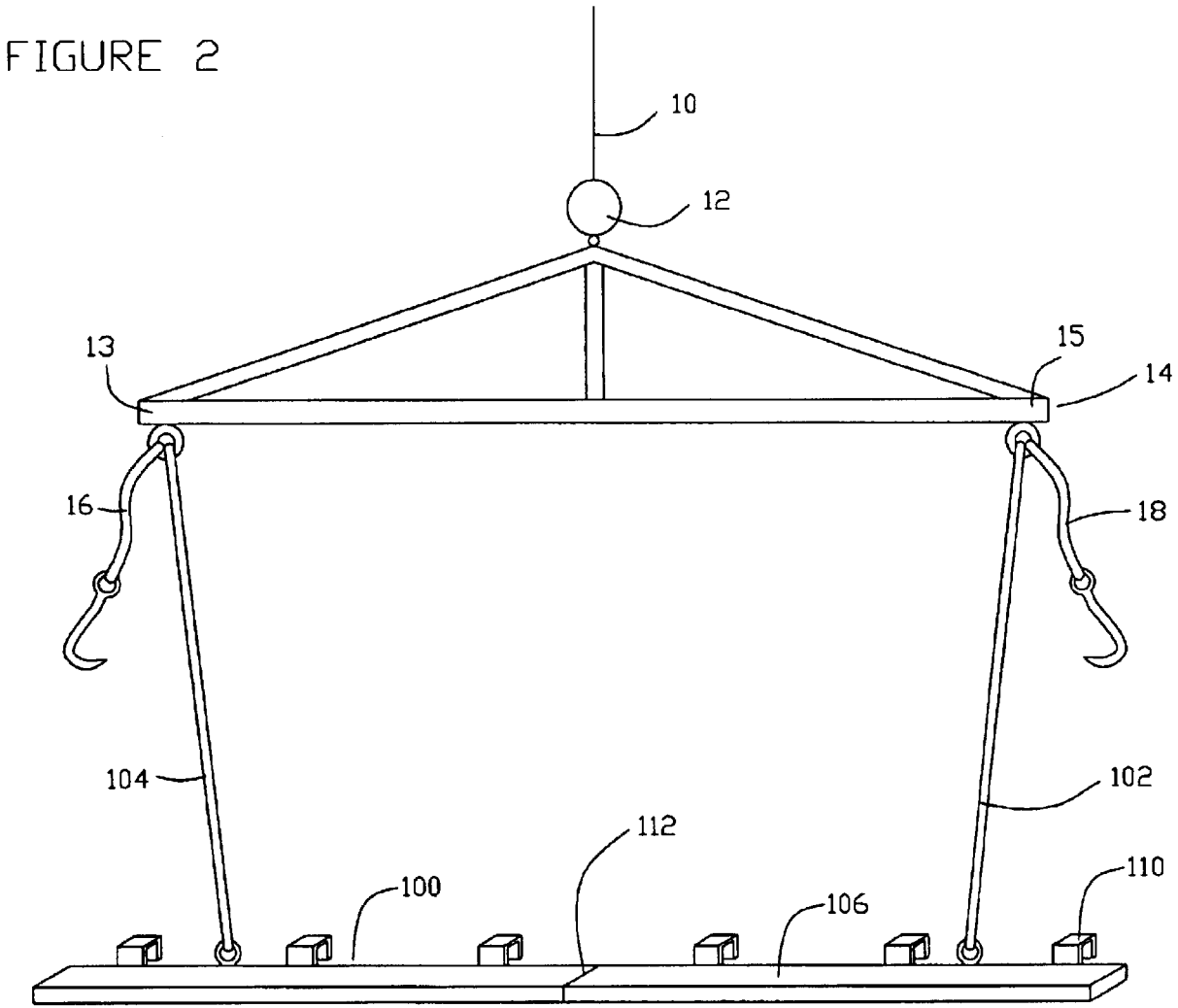
FIG. 2 Shows a view of the device.

FIG. 2 shows details of the stiffener device 100. Two lines 102, 104 attach the stiffener body 106 to the spreader bar 14. In use, the stiffener body 106 is normally attached to the bottom chord of the truss T and the lines 102, 104 are slack as shown in FIG. 1. The stiffener body 106 is attached to the truss T using attachment brackets 110 detailed in FIG. 3. When the stiffener body 106 is removed from the Truss T, for example as the truss T is placed in location, the stiffener body 106 drops until the lines 102, 104 tighten and then hold the stiffener body 106 to the spreader bar 14. As shown in FIG. 2 the stiffener device 100 is ready to load another truss T.

Figure 3:
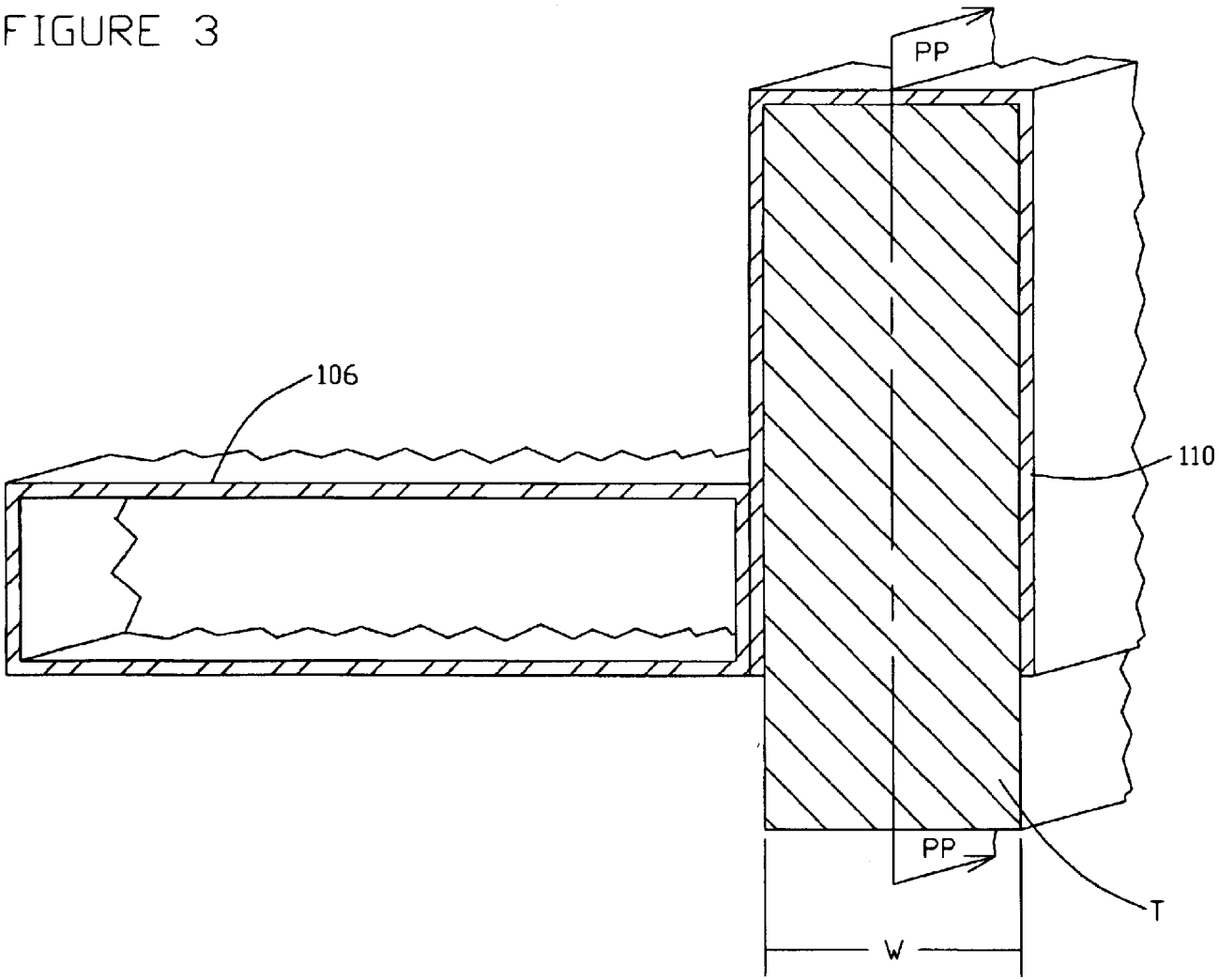
FIG. 3 Shows a cross section of a portion of the device.

FIG. 3 shows details of the stiffener device 100. A long stiffener body 106 is oriented to have a high resistance to bending along its length. Attachment brackets 110 are attached to the stiffener body 106 at several points along the stiffener body 106 length. The bracket 110 hangs over the bottom chord of the truss T and supports it against bending in direction A as shown in FIG. 1 perpendicular to plane PP. Stiffener body 106 can be a long piece of tubular material such as steel. The stiffener body 106 can have relative thin walls and still provide substantial resistance to bending in part because of the orientation of the stiffener body 106. Though shown as having a closed tubular section the stiffener body 106 could be made from other sections such as an angle section. As shown in FIG. 1 the stiffener body 106 can be long but does not need to be the full length of the truss T. As shown the stiffener body 106 is about half the length of the truss T and in many cases this would be enough to prevent bending of the truss T along its long axis. Ideally the stiffener body 106 can have a resistance to bending along the X—X axis that is in a range of 0.5 to 100 times that of the bottom chord of the truss.

FIG. 2 shows a split 112. The stiffener body 106 can be divided into 2 or more sections to make it easier to carry to and from a job site. For example a 24 foot stiffener body 106 can be divided into two 12 foot sections joined at split 112. The two halves could be joined by any conventional method such as interlocking or bolting at the job site to form the stiffener body 106. The advantage of splitting the stiffener body 106 up into 2 or more sections is that the small pieces could be transported more easily to a job site.

In use the stiffener device 100 can be attached by lines 102, 104 to the existing spreader bar 14. The length of lines 102 and 104 can be long enough that they hang slack when the device 100 is in use. Next a truss T can be attached to lines 16 and 18 on either end of the spreader bar 14. Once the lines 16 and 18 are attached the stiffener body 106 can be hung over the bottom chord of the truss T using brackets 110. The weight of the stiffener body 106 can hold it in place over the bottom chord of the truss T. The truss T can then be lifted into place. One or more lines 22 can be attached and used to guide the truss T into place though the need for these lines is reduced when using the stiffener device 100 over the prior art. Once the truss T is in place the spreader bar lines 16 and 18 can be removed from the truss T and the stiffener body 106 can be lifted off the bottom chord of the truss T. Once disconnected the line 10 can swing away carrying the spreader bar 14 and stiffener device 100 attached by lines 102 and 104 to pick up the next truss T. The lines 102 and 104 remain attached throughout the process of setting a series of trusses T and can be permanently attached to a spreader bar 14 used for setting trusses. The stiffener body 106 could be made from a variety of material including wood and plastic but metal is preferred. Though not shown it would be possible to build metal brackets that would allow a piece of lumber to be hung over the bottom chord of a truss such that the piece of lumber would serve the purpose of the stiffener body resisting bending along axis X—X.

Though shown as attached to the bottom chord of the truss T, the stiffener element could be so designed to hang from any points along the truss, for example the stiffener could hang from the top chord or could hang below the bottom chord. Further though the lines 102, 104 are shown as attaching the stiffener body 106 to the ends of the spreader bar 14 these lines 102, 104 could connect to other points of attachments that would keep the stiffener body 106 attached to the spreader bar 14. For example the lines 102,104 could attach back to lift cable 10 or could attach or be an extension of lines 16, 18.

Figure 4:
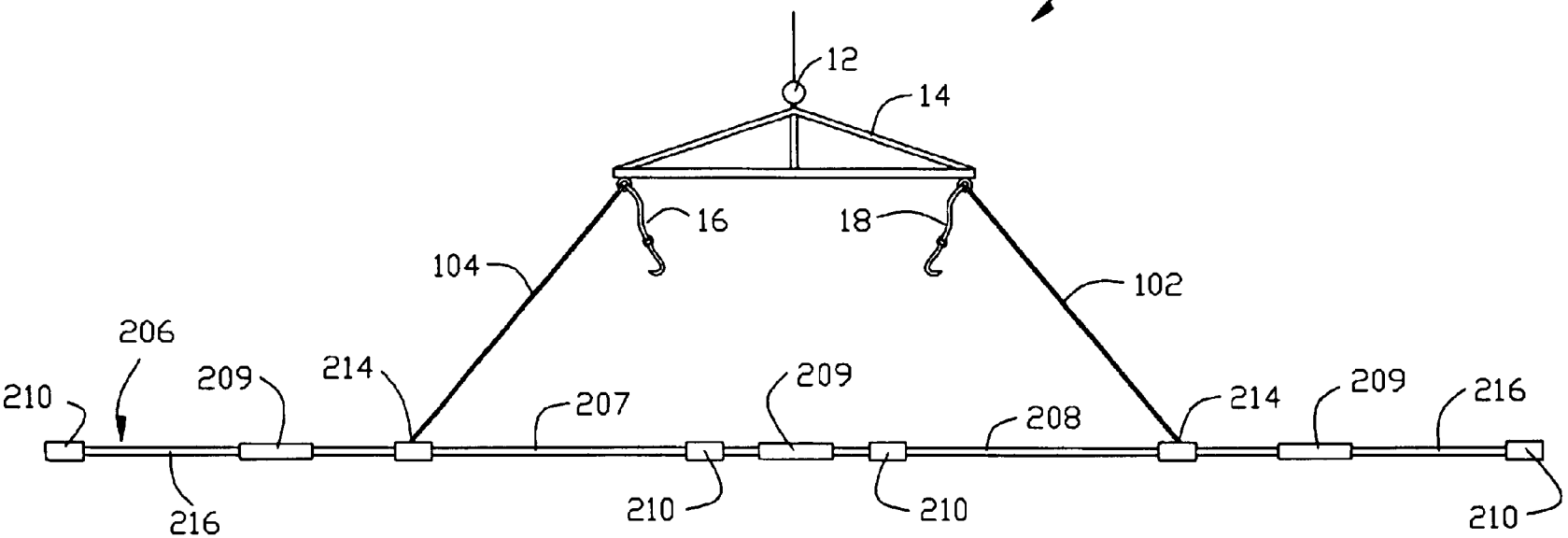
FIG. 4 Shows a second embodiment of the device.

FIG. 4 shows a second embodiment of the device 200. The weight 12 and spreader bar 14 can be the same as above. The stiffener body 206 comes in several pieces. A left wing 207 and a right wing 208 can be connected by a connector sleeve 209. Grab block attachment brackets 210 and cable blocks 214 can be slid onto the left wing 207 and right wing 208 and can be locked in place. Long span add-ons 216 can be added to the ends of left wing 207 and right wing 208 to create a longer stiffener body 206. Thus the assembled length of stiffener body 206 can be changed for different applications giving a longer stiffener body 206, including long span add-ons 216 for longer trusses. A further advantage of device 200 is that it can be disassembled into pieces that are short enough to transport easily to a job site.

Figure 5:
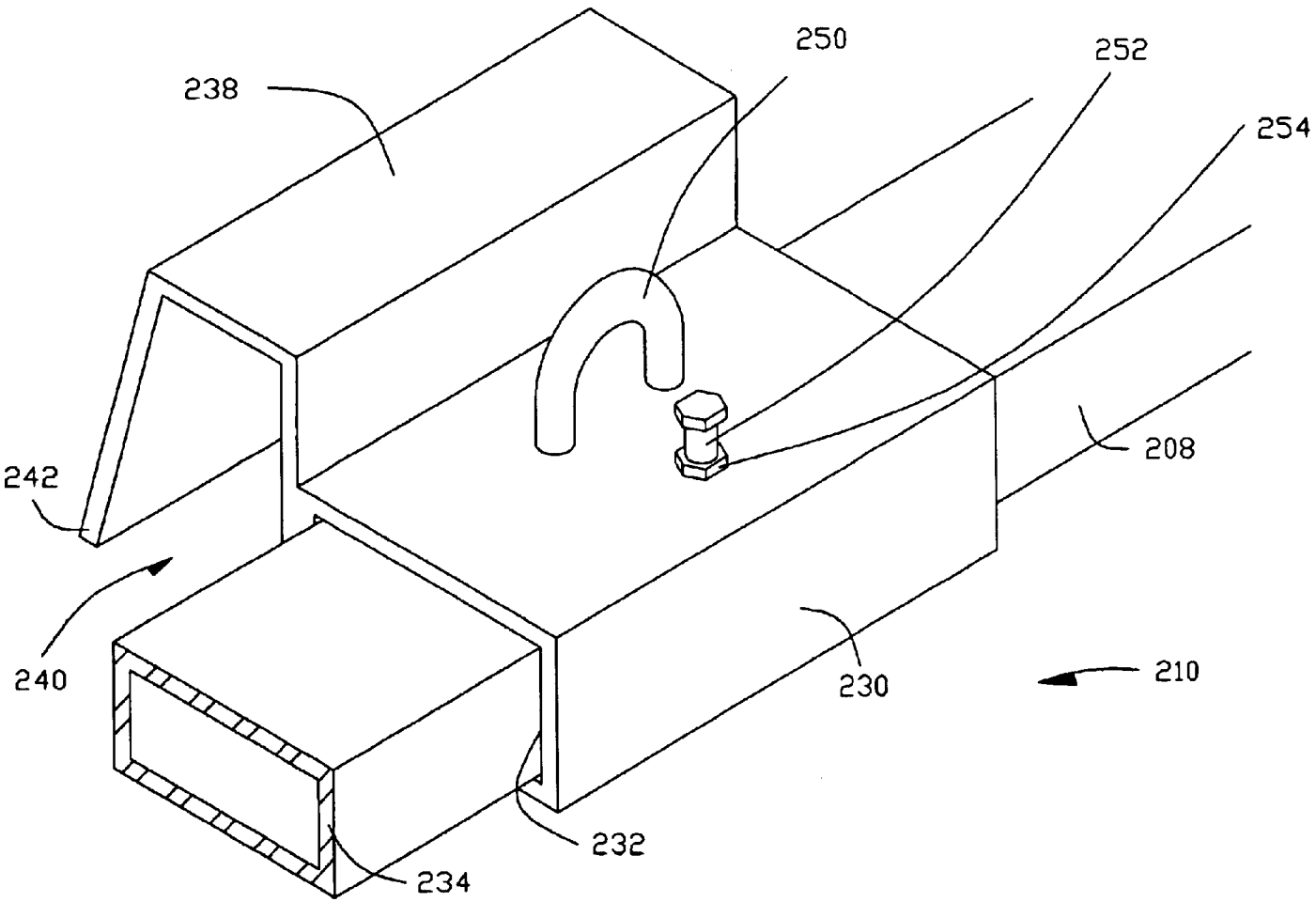
FIG. 5 Shows details of the second embodiment.

FIG. 5 shows details of the grab block attachment bracket 210. The block body 230 has an opening 232 that will fit over the left wing 207, right wing 208 or the long span add-ons 216 each of which can have a common cross sectional shape 234, the grab block attachment bracket 210 is shown mounted to right wing 208 for example. The left wing 207, right wing 208 and the long span add-ons 216 can be tubular as shown or solid and can be wood or metal for example. The grab block attachment brackets 210 include brackets 238 that can fit over the bottom chord of a truss. The bracket 238 can include an opening 240 that is wider adjacent a bottom edge 242 of bracket 238. The grab block attachment bracket 210 can include an attachment loop 250 and a locking device such as a bolt 252 and lock nut 254 that can lock the grab block attachment bracket 210 in place. Though shown as a bolt 252 any suitable locking device such as a lever operated cam lock could work as well. One of lines 102 and 104 can be attached to the loop 250 to support the device 200 from the spreader bar 14. It will be understood that there can be any number of grab block attachment brackets 210 on the device 200 and that one of lines 102 104 need not be attached to every grab block attachment bracket 210.

Figure 6:
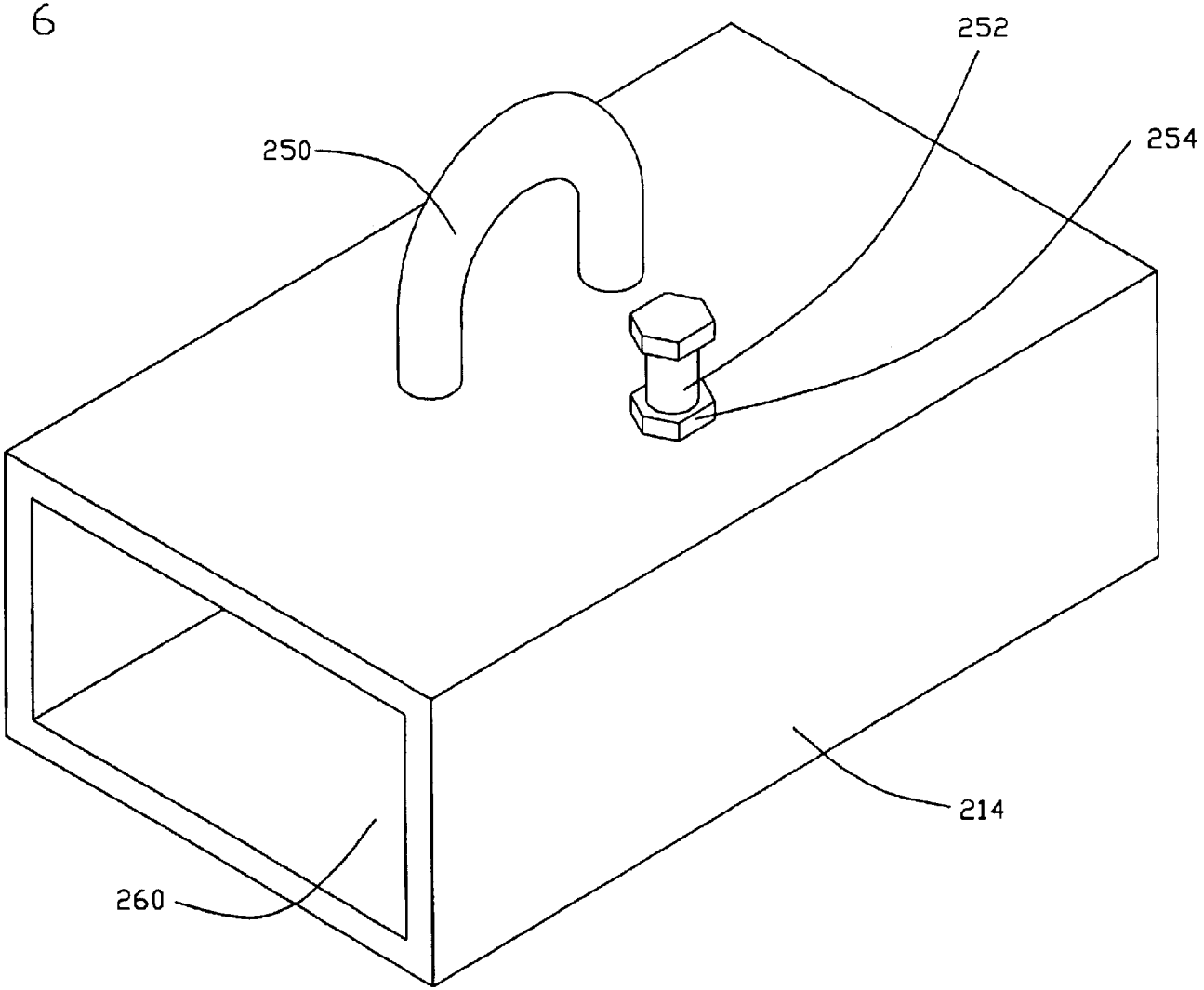
FIG. 6 Shows details of the second embodiment.

FIG. 6 shows details of the cable block 214. The cable block 214 has an opening 260 that allows it to slide onto any of the left wing 207, right wing 208 or long span add-on 216. The cable block 214 has a loop 250 that can be used to attach it to a line 102 or 104. The lines 102 and 104 can be attached as desired either to grab blocks 210 or cable blocks 214. If the lines 102, 104 are attached to the grab block attachment brackets 210 then the cable blocks 214 may not be needed.

Figure 7:
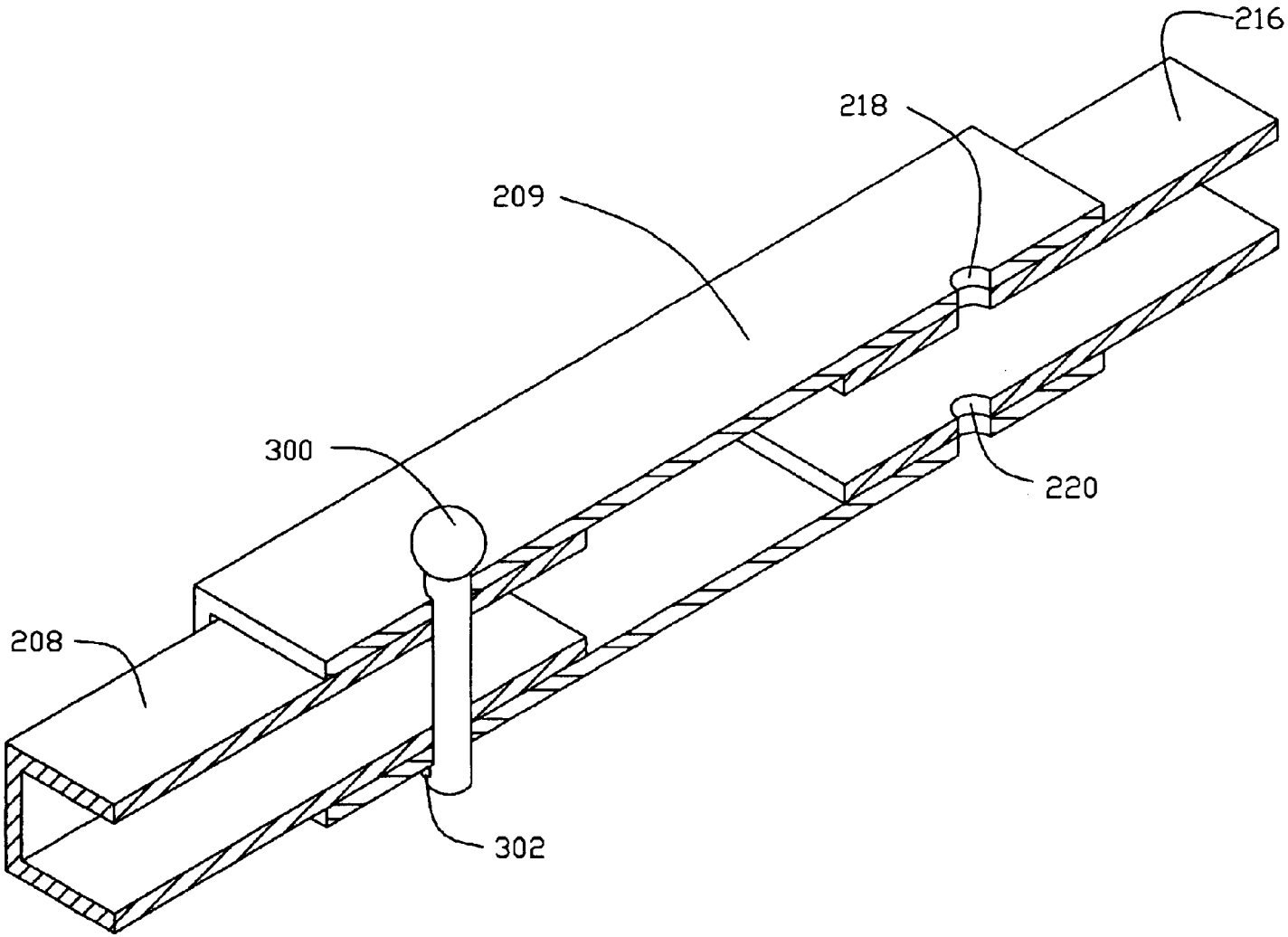
FIG. 7 Shows a cross sectional view of details of the second embodiment.

FIG. 7 gives details of the connector sleeve 209 which can connect right wing 208 or left wing 207 to long span add-on 216. The connector sleeve 209 can include holes 218 that can align with holes 220 in right wing 208 or long span add-on 216. Once aligned a drop pin 300 can drop through holes 218, 220 and hold the device 200 together. A spring loaded ball 302 can be used to hold the drop pin 300 in holes 218, 220.

In use the stiffener device 200 can be attached by lines 102, 104 to the existing spreader bar 14 or to line 10. The length of lines 102 and 104 can be long enough that they hang slack when the device 100 is in use. Next a truss T can be attached to lines 16 and 18 on either end of the spreader bar 14. Before or after the lines 16 and 18 are attached, the stiffener body 206 can be hung in a first position over the bottom chord of the truss T using grab block attachment brackets 210. The weight of the stiffener body 206 can hold it in place over the bottom chord of the truss T. The truss T can then be lifted into place. Once the truss T is in place on a structure such as a building (not shown) the spreader bar lines 16 and 18 can be removed from the truss T and the stiffener body 206 can be lifted off the bottom chord of the truss T. Once disconnected the line 10 can swing away carrying the spreader bar 14 and stiffener device 200 in a second position attached by lines 102 and 104 to pick up the next truss T. The lines 102 and 104 remain attached throughout the process of setting a series of trusses T and can be permanently attached to a spreader bar 14 used for setting trusses.

Figure 8:
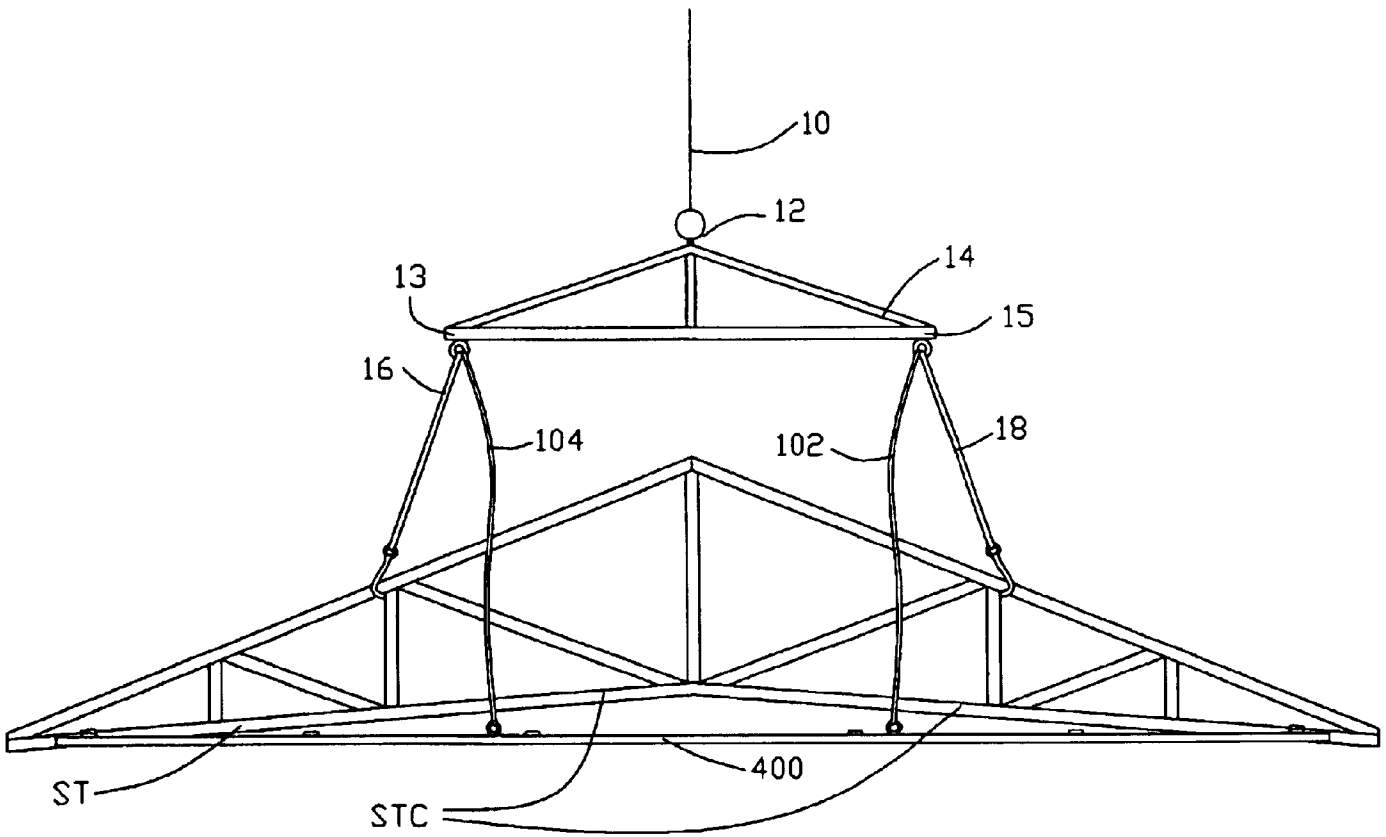
FIG. 8 Shows a third embodiment in use.

FIG. 8 shows a third embodiment of the device 400 in use. The third embodiment of the device 400 can be for use on any long truss including a scissor truss ST. The bottom chord STC of a scissor truss ST may not be flat, when this is the case the grab blocks 410 can be adjustable to match the angle of the bottom chord STC.

Figure 9:
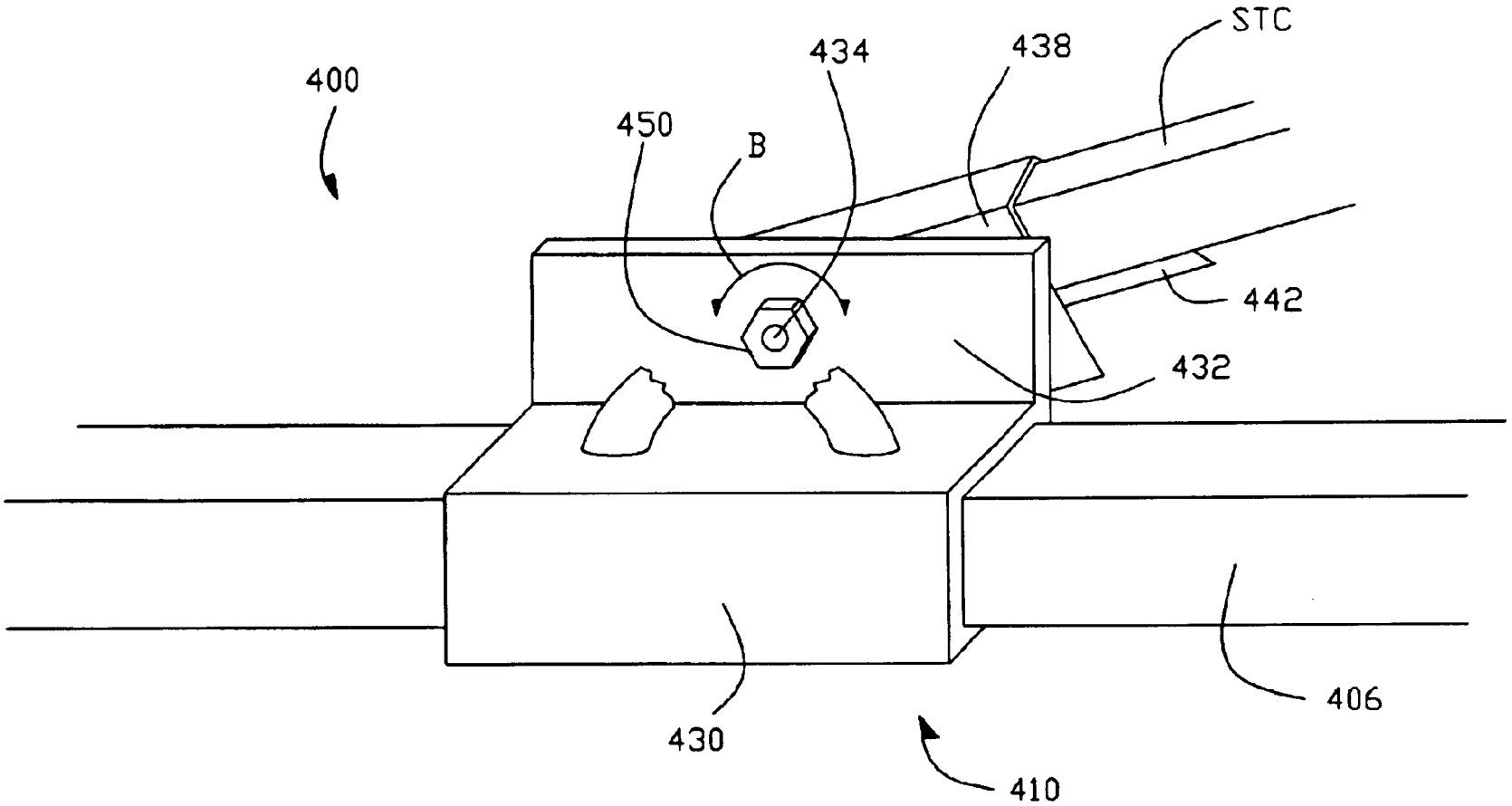
FIG. 9 Shows details of the third embodiment.

FIG. 9 shows some detail of the grab block 410 in use on a scissor truss bottom chord STC. The grab block 410 includes a body 430 slidable on the stiffener body 406. A back plate 432 can include a hole (not shown) through which a bolt 434 can pass to mount rotatable bracket 438. When the nut 450 is loose the bolt 434 and bracket 438 can be rotated about the central axis of the bolt 434 through any angle B. The bracket 438 can be adjusted to match an angle of the scissor truss bottom chord STC such that the bracket opening 442 will fit over the truss chord STC.

The left wing 207, right wing 208 and long span add-ons 216 can be of a variety of material including tubular aluminum which can be fairly light weight and rigid. Though shown in moving a truss it will be understood that the stiffener device could be used in moving any load that might be subject to bending during moving. In addition to the third embodiment shown, it would be possible to hinge the stiffener in the center to allow it to fit the bottom chord of a scissor truss. It will be understood that the above disclosure is for the purpose of exemplifying the invention and should not be construed as limiting.

What is claimed is:

1. A device for use with a lift cable in moving a load, said device comprising;

a lift cable attached to a spreader bar such that said lift cable supports said load;

a stiffener body removably attachable to said load to stiffen said load wherein said stiffener body is attached to said spreader bar and the weight of said stiffener body rests on said load as said lift cable is moving said load, a first line attached to said spreader bar and a second line attached to said spreader bar;

said first and second lines attachable to a load for lifting said load; at least a third line, said third line attaching said stiffener body to said spreader bar, wherein said stiffener body includes a plurality of attachment brackets along a length of said stiffener body, to attach said stiffener body to said load.

2. The device of claim 1 wherein said load is a truss and said attachment brackets are adapted to fit over a bottom chord of said truss and wherein said third line holds the stiffener body attached to said spreader bar even when said stiffener body is not attached to said truss.

3. A device for use with a lift for moving a truss, said device comprising a spreader bar;

a stiffener body adapted to removably attach to a truss to stiffen said truss at least during moving;

wherein said stiffener body has a first position wherein said stiffener body is attached to said truss and a second position wherein said stiffener body is hanging from at least one of said spreader bar or said lift, wherein said stiffener body includes a plurality of attachment brackets spaced along a length of said stiffener body, each bracket including an opening adapted to fit over said truss to hold said stiffener body in said first position.

4. The device of claim 3 wherein said stiffener body includes a first and second line attaching said stiffener body to said at least one of said spreader bar or said lift cable such that said first and second lines support said stiffener body in said second position.

5. The device of claim 4 wherein said stiffener body includes a left wing and a right wing connected by connector sleeve.

6. The device of claim 5 wherein said left and right wing are tubular aluminum.

7. The device of claim 5 wherein said connector sleeve includes drop pins adapted to drop through holes in said connector sleeve and said left and right wings.

8. A device for use with a lift for moving a truss, said device comprising a stiffener body adapted to removably attach to a bottom chord of said truss to stiffen said truss at least during moving;

wherein said stiffener body has a first position wherein said stiffener body is attached to said truss and a second position wherein said stiffener body is hanging from said lift adjacent said truss, wherein said stiffener body includes brackets adapted to fit over the bottom chord to hold the stiffener body on the truss and wherein at least one of said brackets is slidably mounted to the stiffener body.

9. The device of claim 8 wherein said lift includes a spreader bar attached to a lift cable.

10. The device of claim 8 wherein said stiffener body includes a first and second line attaching said stiffener body to said lift such that said first and second lines support said stiffener body in said second position.

11. The device of claim 8 wherein at least one of said brackets is rotatably mounted to the stiffener body.

* * * * *